US005129112A

United States Patent [19]

Schaffer

[11] Patent Number: 5,129,112

[45] Date of Patent: Jul. 14, 1992

[54] BATHTUB CHAIR LIFT

[76] Inventor: Richard C. Schaffer, 3809 Brookhaven Cir., Fort Worth, Tex. 76109

[21] Appl. No.: 714,256

[22] Filed: Jun. 12, 1991

Related U.S. Application Data

[63] Continuation-in-part of Ser. No. 562,466, Aug. 3, 1990, abandoned.

[51] Int. Cl.[5] ..... A47K 3/12

[52] U.S. Cl. ..... 4/560.1; 4/562.1

[58] Field of Search ..... 4/561, 562, 563, 564, 4/565, 566

[56] References Cited

U.S. PATENT DOCUMENTS

| | | | |
|---|---|---|---|
| 2,187,283 | 1/1940 | Scheutz | 4/561 X |
| 3,078,475 | 2/1963 | Turner | 4/562 |
| 3,188,657 | 6/1965 | Cotner | 4/562 |
| 3,280,409 | 10/1966 | Cotner | 4/563 |
| 3,289,217 | 12/1966 | Glover | 4/562 |
| 3,307,204 | 3/1967 | Cotner | 4/563 |
| 3,918,108 | 11/1975 | Feyerherm | 4/563 |
| 4,091,478 | 5/1978 | Hardwick et al. | 4/562 |
| 4,928,330 | 5/1990 | Moore | 4/562 |
| 4,996,728 | 3/1991 | Nolan | 4/561 X |

FOREIGN PATENT DOCUMENTS

| | | | |
|---|---|---|---|
| 2007570 | 4/1978 | Fed. Rep. of Germany | 4/562 |
| 2206007 | 1/1980 | Fed. Rep. of Germany | 4/563 |

*Primary Examiner*—Henry J. Recla
*Assistant Examiner*—Robert M. Fetsuga
*Attorney, Agent, or Firm*—Arthur F. Zobal

[57] ABSTRACT

A support is provided which is attachable to the side walls of the bathtub. An actuator is provided which includes an elongated tubular member and an inner member adapted to be moved to inner and outer positions relative to the tubular member. Structure is provided for coupling the actuator to the support. A D.C. powered reversible, electric motor is provided for moving the inner member of the actuator to its inner and outer position. A chair is coupled to the outer end of the inner member and a coupling apparatus is provided for pivotally and slidably coupling the chair to the support for allowing the chair to be moved to an upper and lower positions above the bottom of the bathtub and sideways when in the upper position. In addition, a control system is located within the reach of a person sitting in the chair while the chair is in its upper and lower positions above the bottom of the tub to allow the person to control the electric motor to move the inner member of the actuator to its inner and outer positions and hence the chair to its upper and lower positions.

9 Claims, 8 Drawing Sheets

BATHTUB CHAIR LIFT

This application is a continuation-in-part of U.S. patent application Ser. No. 07/562,466 filed Aug. 3, 1990, now abandoned.

BACKGROUND OF THE INVENTION

1. Field of the Invention

The inventions relates to an apparatus for moving a chair into and out of the bathtub to facilitate bathing of persons such as invalids or elderly persons.

2. Description of the Prior Art

A variety of bathtub chair lift devices are known in the prior art. Most of these devices however are less than satisfactory for a number of reasons. Many of the devices require special or modified tub structures which are expensive. In addition, many of these devices can be used only with a given type of tub or with a tub installed in a given manner. In addition, the prior art bathtub chair lift devices in many instances take up too much tub space and allow little room for the person to be bathed. Known devices also have many components which are disposed within the tub structure and thus are in contact with the bath water. This is undesirable, since it is unsanitary and makes it difficult to keep the tub and chair lift device structure clean. Many of the prior art devices also are complicated and expensive. In addition, many of the prior art devices cannot be operated by the bather but require the aid of another person.

SUMMARY OF THE INVENTION

It is an object of the present invention to provide a bathtub chair lift apparatus which does not require a special or modified tub structure.

It is another object of the invention to provide a bathtub chair lift apparatus which can be used on many types of tubs.

It is still another object of the present invention to provide a bathtub chair lift apparatus which occupies very little of the tub space, and has a minimum of components that are in contact with the bath water.

The bathtub chair lift of the present invention also has a minimum of parts; is inexpensive to manufacture; is easy and safe to use; and can be operated by the bather without the help of another person.

The bathtub chair lift comprises support means adapted to be coupled to the side walls of the bathtub and an actuator having an elongated tubular member with and an inner member movable to inner and outer positions. Means is provided for coupling the actuator to the support means. Means also is provided including a D.C. powered, reversible, electric motor for moving the inner member to its inner and outer positions.

A chair for supporting a person is coupled to the inner member of the actuator. Coupling means is provided for pivotally and slidably coupling the chair to the support means for allowing the chair to be moved to upper and lower positions above the bottom of the bathtub and sideways when in the upper position. In addition, control means is provided within reach of a person sitting in the chair while the chair is in the upper or lower positions above the bottom of the bathtub to allow the person to control the electric motor to move the inner member to its inner and outer positions and hence the chair to the upper and lower positions.

In one embodiment, the support means comprises a main support post and bathtub wall support means coupled to the main support post. The main support post has a lower end and an upper end with the lower end adapted to engage and be supported by the bottom of the bathtub and with the upper end extending above the walls of the bathtub. The bathtub wall support means is adapted to be coupled to at least one wall of the bathtub for providing support for the main support post. The coupling means pivotally and slidably couples the chair to the main support post for allowing the chair to be moved to the upper and lower positions above the bottom of the bathtub and sideways when in the upper position.

In one embodiment, the bathtub wall support means comprises a platform having two spaced apart arms with ends connected together by a connecting portion extending transverse to the two arms defining a chair receiving space between the two arms. The two arms are adapted to rest on the upper ends of the walls of the bathtub with the lower end of the main support post engaging the bottom of the bathtub. At least one secondary support post is coupled to the connecting portion of the platform and to the main support post.

In another embodiment, the bathtub wall support means comprises clamp means coupled to the main support post and adapted to be clamped to at least one wall of the bathtub.

In another embodiment, the support means comprises a platform which is adapted to engage the upper rim of the walls of the bathtub and a member pivotally coupled to the platform which can extend downward at an angle into the bathtub and to engage the bottom thereof. The chair is pivotally coupled to the actuator and also pivotally coupled to the base platform and has at least one roller assembly for engaging the platform for facilitating movement of the chair between its upper and lower positions.

BRIEF DESCRIPTION OF THE INVENTION

DESCRIPTION OF THE PREFERRED EMBODIMENTS

Figure 1:
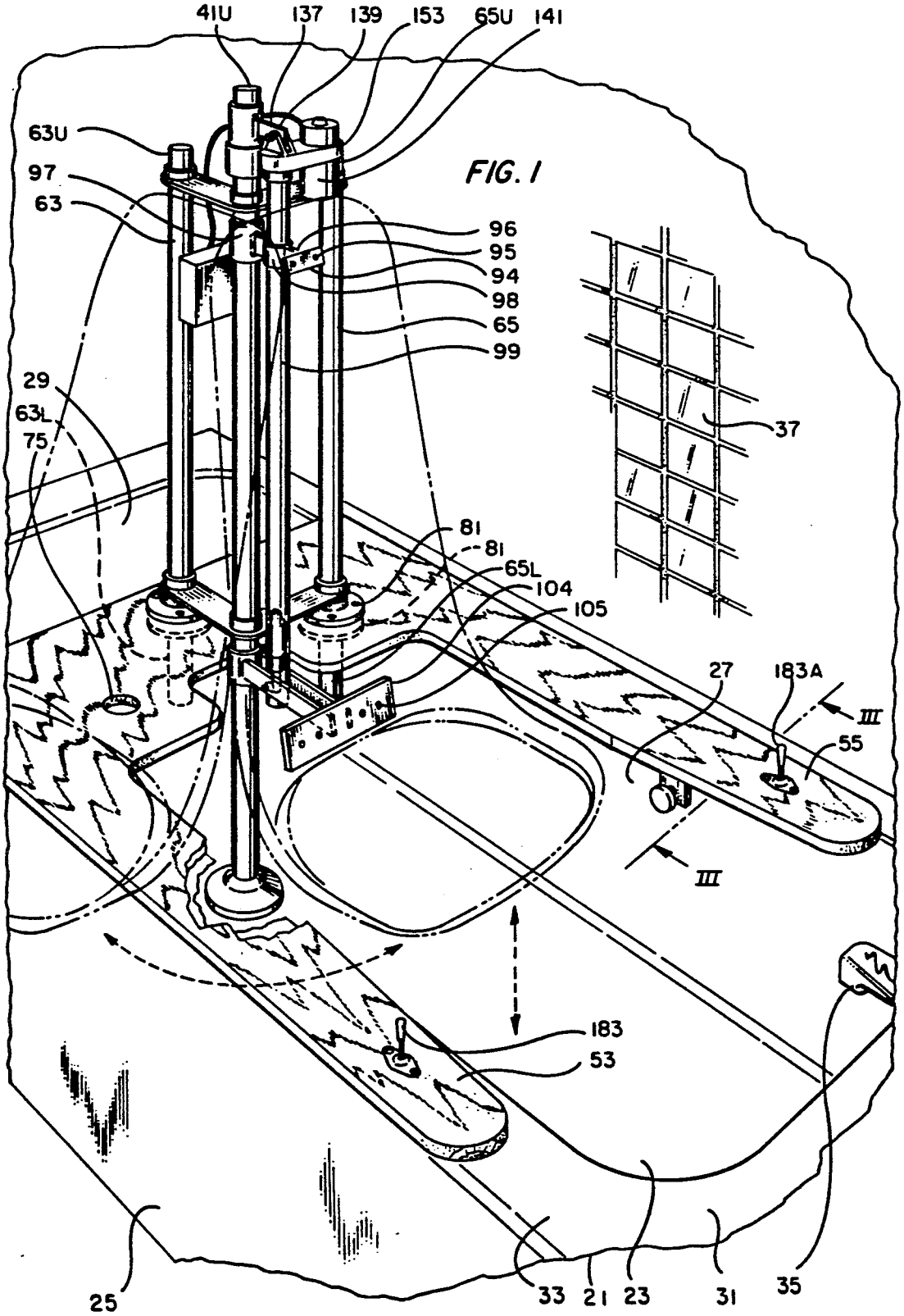
FIG. 1 is an isometric view of the bathtub chair lift of one embodiment of the invention installed in place.
Figure 2A:
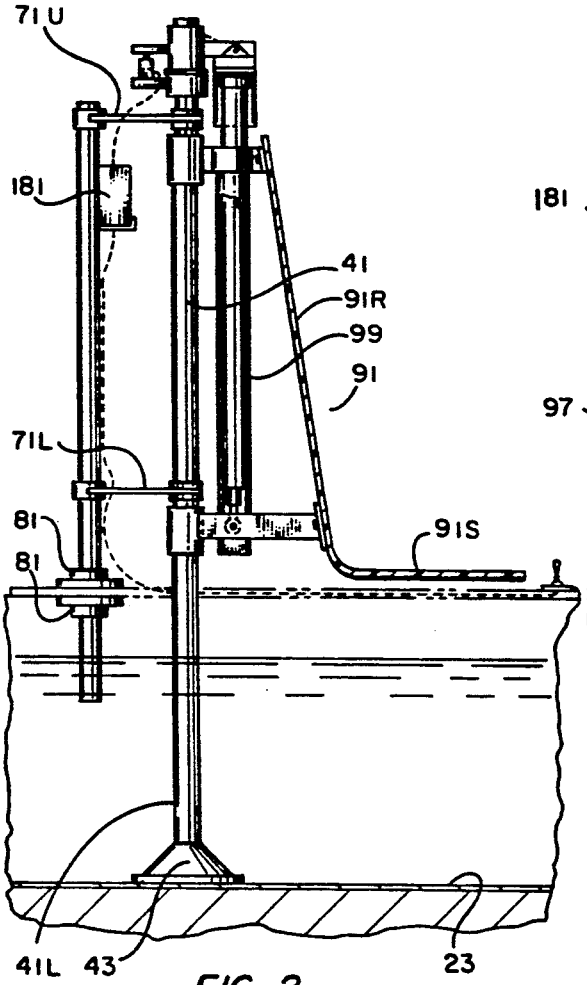
FIG. 2A is a side view of the bathtub chair lift of the apparatus of FIG. 1 with the chair in an upward position.
Figure 2B:
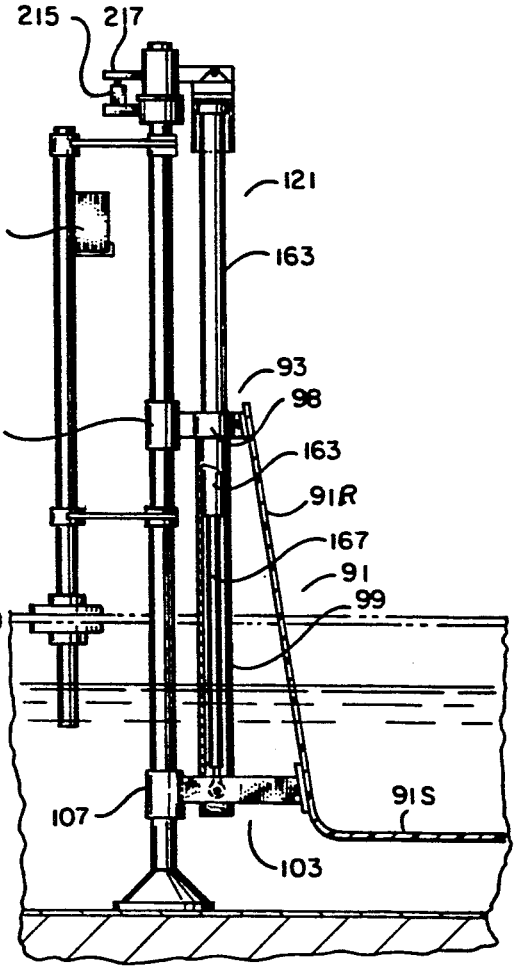
FIG. 2B is a side view similar to that of 2A with the chair in a lower position within the bathtub.
Figure 3:
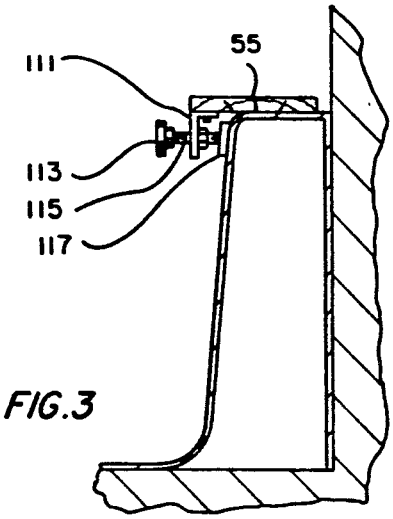
FIG. 3 is a cross-sectional view of FIG. 1 taken along lines 3—3 thereof.

Referring now to FIGS. 1–9 of the drawings, there is disclosed in FIG. 1 a conventional bathtub 21 having a bottom 23, two sidewalls 25 and 27 and two end walls 29 and 31 extending upward to an upper rim 33. The water faucet is shown at 35. The drain (not shown) is located below the faucet 35. The side wall 27 is located next to the bathroom wall 37 such that one can enter and leave the tub 21 over sidewall 25.

The bathtub chair lift of the invention is constructed to be used with the conventional bathtub as shown in FIG. 1. The lift apparatus of the invention comprises a main support post 41 having an upper end 41U and a lower end 41L. The post 41 is a metal cylindrical member having a base 43 at its lower end adapted to engage and be supported by the bottom 23 of the tub 21 with its upper end 41U extending vertically upward to a level above the rim 33.

A platform 51 is provided having two spaced apart arms 53 and 55 with ends 53A and 55A connected together by a connecting portion 57 extending transverse to the arms defining a chair receiving space 59 between the two arms 53 and 55. The platform is C shaped with the arms 53 and 55 and connecting portion 57 having inner edges 53E, 55E, and 57E defining the space 59. The inner edge 57E of the connecting portion 57 has a curved slot 57S at the center line 61 midway between the arms 53 and 57 for receiving the main post 41.

The lower sides of the arms 53 and 55 of the platform 51 are adapted to engage and be supported by the upper rim 33 of the sidewalls 25 and 27 with the connecting portion 57 bridging the space of the tub between the sidewalls 25 and 27.

Two secondary support posts 63 and 65 are provided which have their lower ends 63L and 65L connected to and supported by the connecting portion 57 of the platform 51 to allow the posts 63 and 65 to extend vertically upward parallel with the main support post 41. L-shaped brackets 71L and 71U connect the lower portions 63L and 65L and the upper ends 63U and 65U of the posts 63 and 65 to the main post 41 for support purposes.

Figure 6:
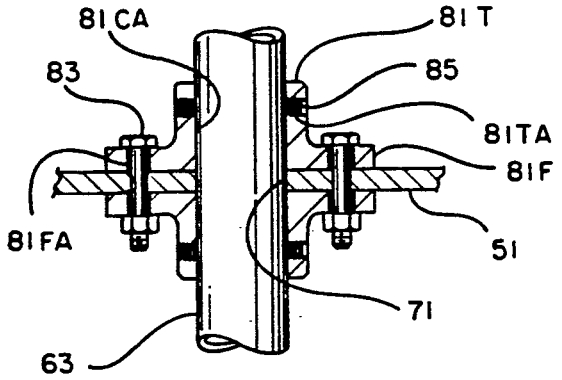
FIG. 6 is an enlarged partial cross-section of the platform and two footplates of the apparatus of the apparatus of FIG. 1.

Three apertures 71, 73 and 75 are formed through the connecting portion 57 at positions such that they form a right angle with aperture 71 at the apex. Aperture 71 is located along center line 61 and apertures 73 and 75 are located on opposite sides of the center line 61. The secondary posts 63 and 65 are adapted to have their lower ends located and secured in either apertures 71 and 73 or apertures 71 and 75. Posts 63 and 65 are shown located in apertures 71 and 73 and are secured to the connecting portion 57 by footplates 81. Referring to FIG. 6, each footplate 81 comprises a hollow cylindrical tube 81T having a flange 81F extending outward from one end. Apertures 81FA are formed through the flange for receiving bolts 83 and threaded apertures 81TA are formed through the tube 81T for receiving set screws 85. Two footplates 81 are removably secured to opposite sides of the connecting portion 57 with bolts 83 such that the central apertures 81CA formed therethrough are in alignment with the aperture 71. Post 63 is inserted through the two footplates 81 and through aperture 71 and removably secured to the tubes 81T of the footplates pairs 81 by set screws 85. Similarly, two footplates 81 are removably secured to opposite sides of connecting portions 57 around aperture 73 with bolts 83 and the post 65 inserted through the footplates and through aperture 73 and removably secured to the footplates 81 with set screws 85.

Figure 7:
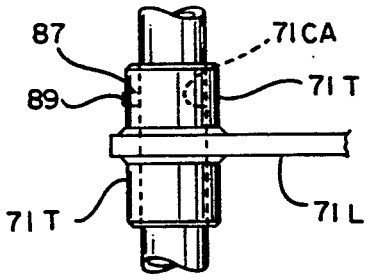
FIG. 7 is an enlarged portion of one of the brackets of the apparatus of the apparatus of FIG. 1.
Figure 8:
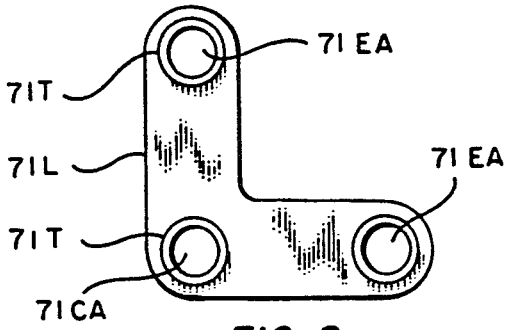
FIG. 8 is a plan view of one of the brackets of the apparatus of FIG. 1.

The brackets 71L and 71U are identical to each other. Referring to FIGS. 7 and 8, each bracket forms a right angle and has apertures 71EA formed through its two ends and an aperture 71CA formed through its apex portion with hollow tubular members 71T extending from opposite sides of the bracket in alignment with apertures 71EA and 71CA. Aperture 71CA receives the main post 41 and apertures 71EA receive the secondary posts 63 and 65 respectively. The tubular members 71T have threaded apertures 87 formed therethrough for receiving set screws 89 for removably securing brackets 71L and 71U to the posts 41, 63, and 65.

The height of the platform 51 relative to the lower end 41L of the main post can be adjusted to accommodate tubs having sidewalls of different heights by loosening the set screws 85 and 89 in footplates 81 and in brackets 71L and 71U, positioning the lower end 41L of the post 41 against the bottom 23 of the tub 21 with the underside of the arms 53 and 55 resting against the rims 33 of the side walls 25 and 27 of the tub 21 and tightening the set screws 85 and 89 to secure the posts 63 and 65 to the platform 51 and to the post 41 by way of the brackets 71L and 71U.

If desired, the posts 63 and 65 may be welded in the apertures 71EA of the brackets 71U and 71L and the set screws 89 eliminated. Height adjustment of the platform in this case will be made with the use of set screws 85 of the footplates 81.

Brackets 111 with adjusting knobs 113 are secured to the undersides of the arms 53 and 55 to insure that the arms are tight against the rim 33 of the sidewalls 25 and 27 of the tub 21. Each bracket 111 has a threaded aperture formed therethrough through which a threaded shaft 115 of the knob is screwed. The end of the shaft 115 has a base 117 pivotably coupled thereto for engaging the sidewall of the tub when the knob 113 is screwed in the appropriate direction. The base 117 can be released from the sidewall of the tub by screwing the knob 113 in an opposite direction.

A seat 91 having a horizontal seat portion 91S and an upward extending rear portion 91R is provided for supporting a person.

The seat 91 is slidably and pivotally coupled to the main post 41 by way of upper and lower brackets 93 and 103. Upper bracket 93 has a plate 94 attached to the back side of seat rear portion 91R by rivets 95. An arm 96 extends rearward from the plate 94 to a hollow tubular bearing member 97 which receives the post 41 for slidable and pivotal movement of the bearing member 97 along and about the post 41. The arm 96 also has a hollow intermediate tubular band 98 for receiving a tubular member 99 which is connected to bracket 93 and to bracket 103.

Lower bracket 103 has a plate 104 attached to the back side of seat rear portion 91R by rivets 105. Two spaced apart arms 105A and 105B extend rearward from the plate 104 to a hollow tubular bearing member 107 which receives the post 41 for slidable and pivotal movement of the bearing member 107 along and about the post 41.

Thus the seat 91 can slide to a lower position below the arms 53 and 55 and to an upper position above the arms 53 and 55 and at the upper position it may be pivoted to one side for loading and unloading purposes.

In the lower position, the seat portion 91S will be in the water in the tub. The distance between the inside edges 53E and 55E of the arms 53 and 55 is sufficient to allow the seat 91 and a person seated thereon to pass between the arms while the seat 91 is moved between its upper and lower positions.

Figure 4:
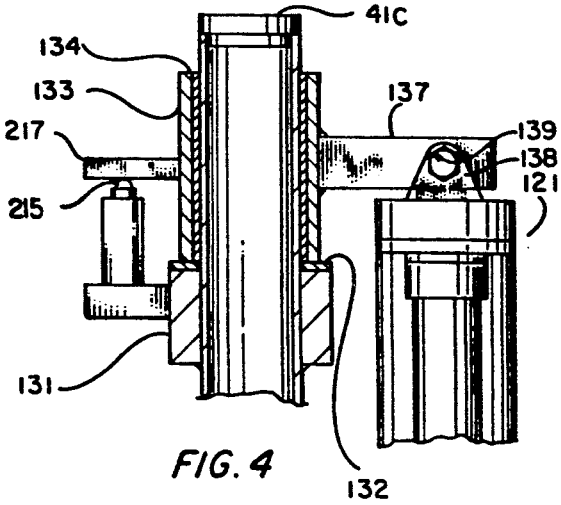
FIG. 4 is a partial cross-sectional view of the upper portion of the main support post of the apparatus of FIG. 1.

A tubular actuator 121 is coupled to and supported by the upper end 41U of the post 41 for moving the seat 91 to it upper and lower positions. A tubular member 131 is welded around the upper end 41U of the post 41, as shown in FIG. 4. It has an annular bearing member 132 at its upper edge which supports a tubular bearing member 133 with an interior tubular bearing member 134 which is located around the upper end 41U of the post 41. A cap 41C is provided at the upper end of the post 41 to close the opening into the tubular post 41. Welded to the exterior of the bearing member 133 is a bracket 137 to which the upper tabs 138 of the actuator 121 is pivotally coupled by way of a bolt 139. The actuator 121 is coupled to the chair 91 for moving it between its upper and lower positions. The bearing members 131–134 allow the actuator 121 to rotate about the post 41 with the chair sideways when in its upper position for loading and unloading purposes.

The actuator 121 is commercially available device which may be purchased for example from Dayton Electric Manufacturing, Co., of Chicago, Illinois. The actuator employed may be a model 62087 actuator.

Figure 9:
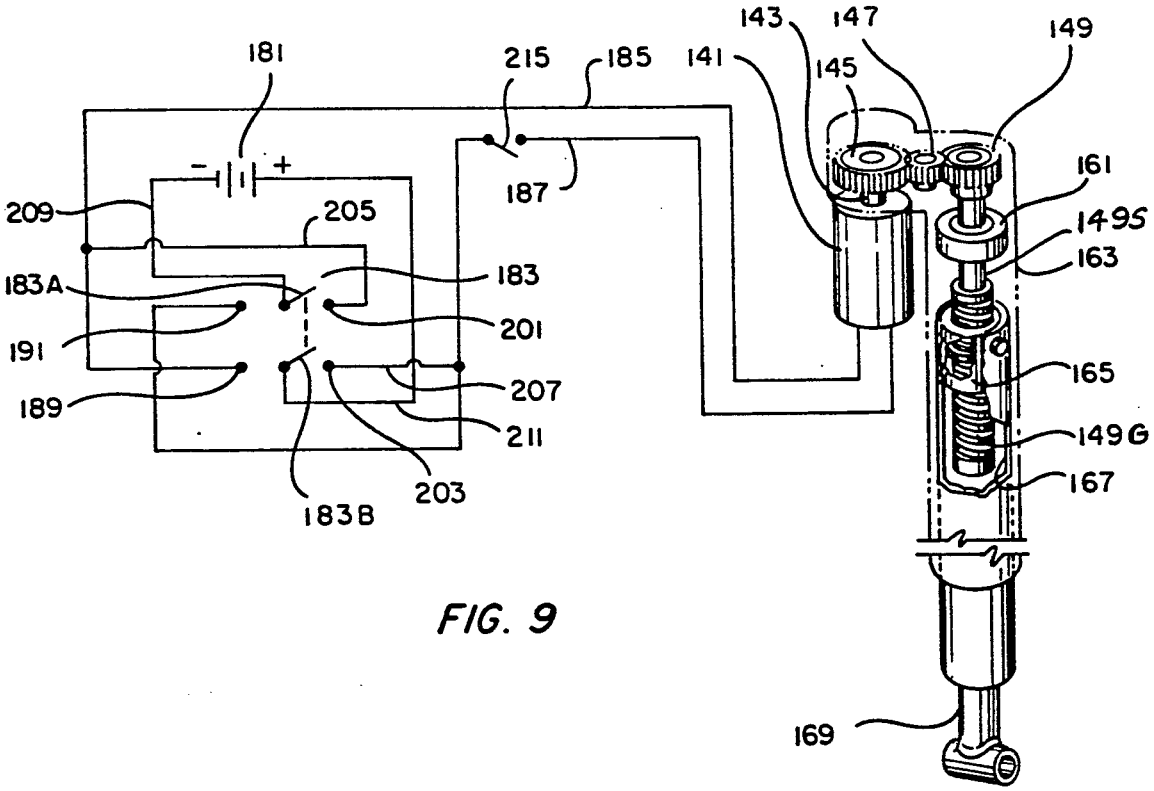
FIG. 9 is a schematic of the electrical system for controlling the electric motor of the actuator of the apparatus of the invention.

Referring to FIG. 9, the actuator 121 comprises a reversible electric motor 141 having a shaft 143 connected to gear 145 which drives a gear 147 which in turn drives a gear 149 attached to a shaft 149S having a worm gear 149G. The motor and gears are located in a housing 153 which is secured to bracket 137 by way of tabs 138 and bolt 139. Shaft 149 rotatably extends through end member 161 which is secured to tubular member 163 which in turn is slidably located within tubular member 99. End member 161 is secured to the housing 153 and structure is provided for supporting the motor 141 and members 145, 147 and 149 for rotation. Worm gear 149G extends through a nut 165 which supports a member located in the groove of the worm gear such that rotation of worm gear 149G in one direction moves the nut 165 downward and rotation of the worm gear 149G in an opposite direction moves the nut 165 upward within tubular member 163. A tubular member 167 is connected to the nut 165 for upward or downward movement with the nut and a rod 169 is connected to the end of the tubular member 167. The end of the rod 169 is pivotally connected to the brackets 105A and 105B by pin 171.

The motor 141 is a D.C. operated motor which is supplied with D.C. power by way of a battery 181, electrical leads and a switch 183 supported by the arm 53. Battery 181 may be a 12 volt, 35 amp. battery.

The electrical system comprises electrical leads 185 and 187 connected to the motor 141 and to terminals 189 and 191 respectively. Terminals 201 and 203 are connected to leads 205 and 207 which are connected to leads 185 and 187 respectively. Switch 183 comprises two poles 183A and 183B which move together and which are connected to the minus and plus sides of the battery 181 respectively by way of leads 209 and 211. Switch 215 is a two position switch which will disconnect when the chair is rotated out of a center position with the center of the tub whereby power to the motor 141 will be disconnected. Poles 183A and 183B may be moved together to contact terminals 201 and 203 respectively to apply power to motor 141 (when switch 215 is closed) to rotate its shaft in one direction. Poles 183A and 183B may be moved together to contact terminals 191 and 189 respectively to apply power to the motor 141 (when switch 215 is closed) to rotate the motor in an opposite direction.

A knob 217 attached to bearing member 133 closes switch 215, attached to member 131, when the chair is centered with the tub. Switch 215 is spring biased to the open position.

Figure 5:
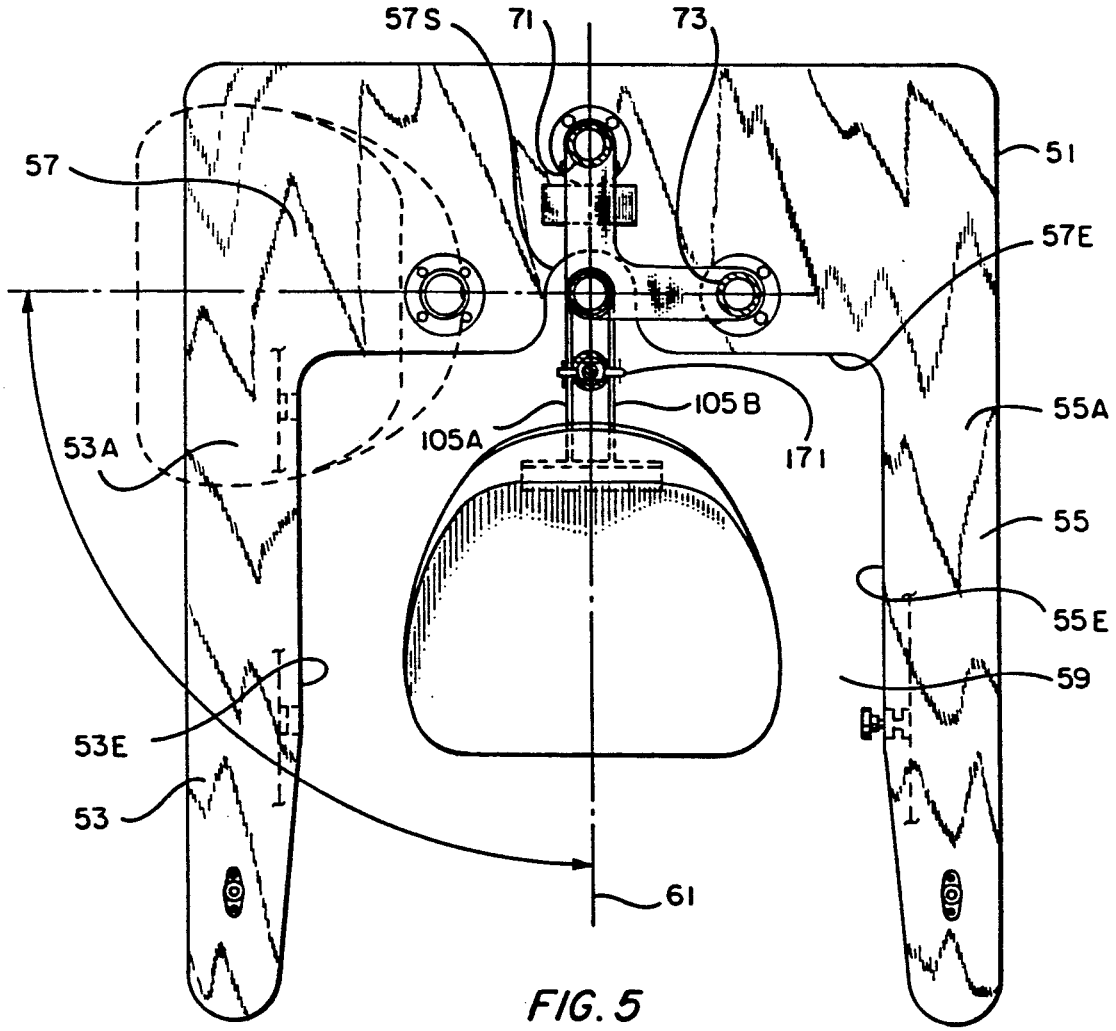
FIG. 5 is an elevational view of the chair lift apparatus of FIG. 1 as seen from above with the chair located at an upper position for pivotal movement sideways above one of the arms.

The operation of the system will now be described. Assume that the chair 91 is in the upper position and in the sideways position above the arm 53 as shown in FIG. 5. In this position, the seat portion 91S of the seat 91 will be slightly above the level of the sidewall 25 and the arm 53 whereby the person can seat himself in the seat. The person then will swing his feet over the side of the tub and he then will rotate himself in alignment with the center line of the tub at which point the switch 215 will close. The person then will move the switch 183 and hence the poles 183A and 183B to contact terminal 201 and 203 respectively. This will apply power to the motor 141 to rotate it in a direction to cause the actuator to move the seat downward to a level below the rim 33 and somewhat above the bottom 23 whereby the person will be in the water within the tub. When the desired level is reached, the operator can move the switch 183 to the neutral position whereby the poles 183A and 183B contacts neither of the terminals 201 and 203 or 191 and 189. When the person desires to get out of the tub, he will operate the switch 183 to move poles 183A and 183B to contact terminals 191 and 189 respectively to apply power in an opposite direction to the motor 141 to cause the actuator to move the chair to an upward position above the level of the arms 53 and 55. When this level is reached, the operator will move the switch 183 to the neutral position to stop movement of the motor. When the operator is in the upper position, he then will swing the chair sideways above the arm 53 and remove himself or be removed from the chair. In this position of the chair, the switch 215 will open. The lowest level to which the seat portion 91S can be moved is determined by the bearing members 97 and 107 engaging the bracket 71L and the base member 43 respectively. The maximum height to which the seat portion 91S can be moved is determined by the bearing members 97 and 107 engaging the brackets 71U and 71L respectively. There are adjustable limit switches in the actuator 121 which control the maximum downward and upward extension and prevent the chair from pushing down on the bottom of the tub or raising too high out of the tub.

In FIG. 1, the bathtub is shown such that the sidewall 27 is against the wall 37 of the bathroom and the sidewall 25 faces the interior space of the bathroom whereby the person normally will get into and out of the tub over the sidewall 25. The apparatus can be adjusted to allow the chair to be swung over arm 55 in the event that the sidewall 25 is against the wall of the bathroom and the sidewall 27 is next to the interior space of the bathroom. For adjustment purposes, the secondary post 63 and 65 will be removed from the aperture 71 and 73 and inserted in aperture 75 and 71 respectively and secured to the platform 51 with the footplates 81 in this position thereby allowing the chair 91 to be swung above the sidewall 27 and hence the arm 55 when in an upward position for allowing the person to get into and out of the chair from the side 27 of the bathtub. Brackets 71U and 71L will be secured to the posts 63, 65, and 41 as described above. The electrical leads may be connected to the switch 183A in the arm 55.

There now will be described the embodiment of FIGS. 10–13.

Figure 10:
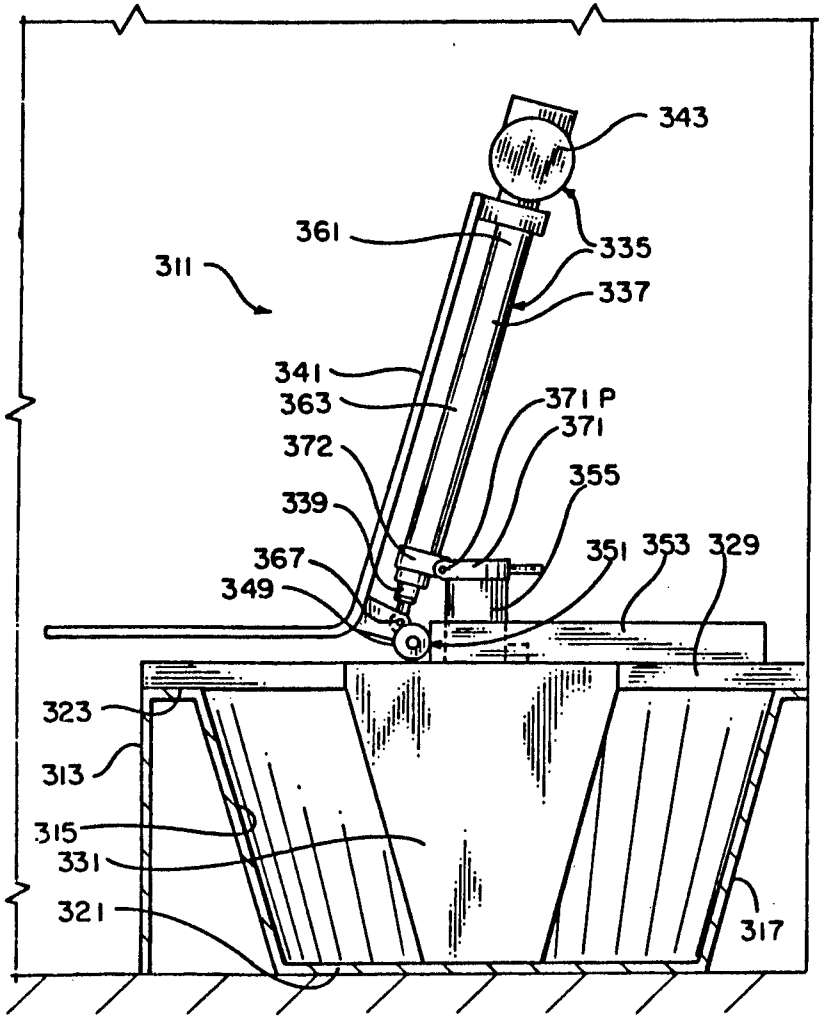
FIG. 10 is a view of another embodiment of the invention in a loading position, with the lift chair rotated outward, as seen from a mid-region of the bathtub, with the tub structure in cross-section.

As shown in FIG. 10, lift device 311 is adapted for placement in bathtub 313. Bathtub 313 includes sidewall 315, sidewall 317, backwall 319, and tub bottom 321. Sidewalls 315, 317, and backwall 319 each terminate at an upper rim surface 323, 325, 327. Lift device 311 is adapted for easy placement in and removal from bathtub 313.

Lift device 311 includes base 329 which engages a portion of upper rim surface 323, a portion of upper rim surface 325, and a portion of upper rim surface 327. In the preferred embodiment, base 329 is adapted for placement at the rear of the tub.

Figure 11:
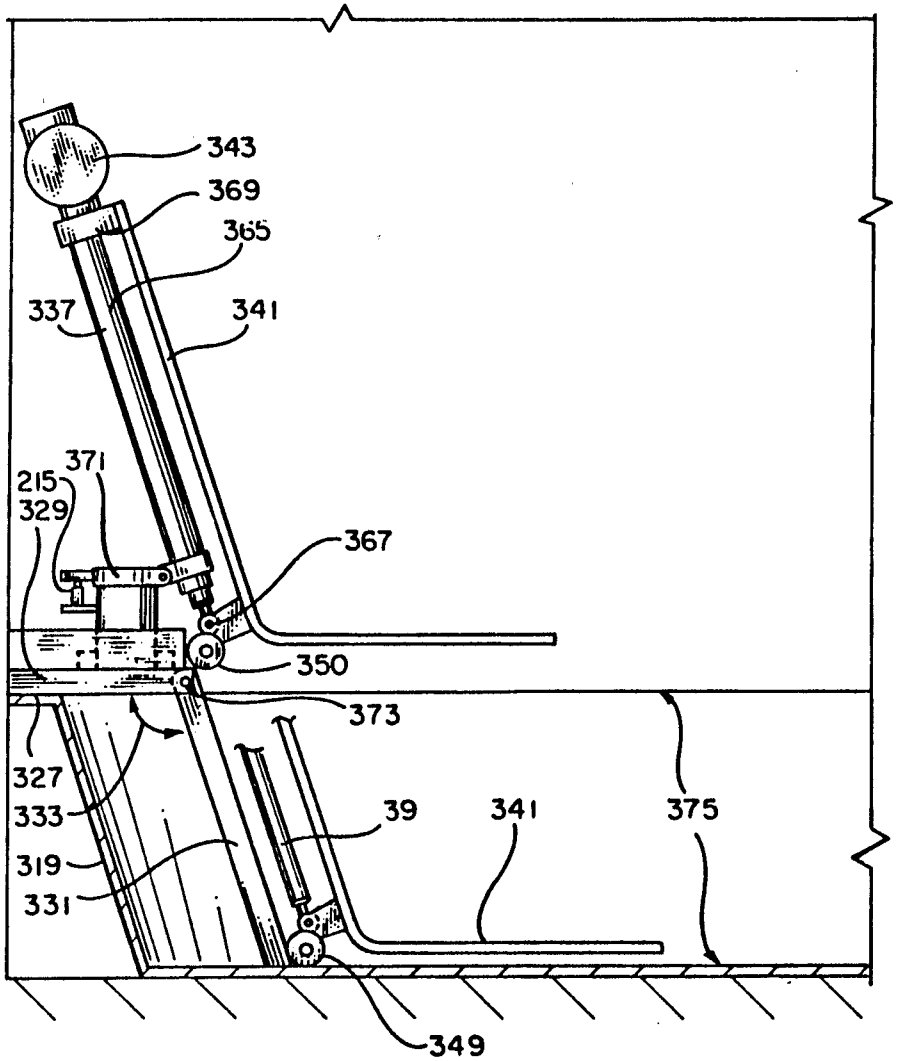
FIG. 11 is a side view of the device of FIG. 10 in a loading position, with the lift chair rotated into axial alignment with the tub, and with the lift device in the bathing position, said bathtub being shown in partial longitudinal section.
Figure 13:
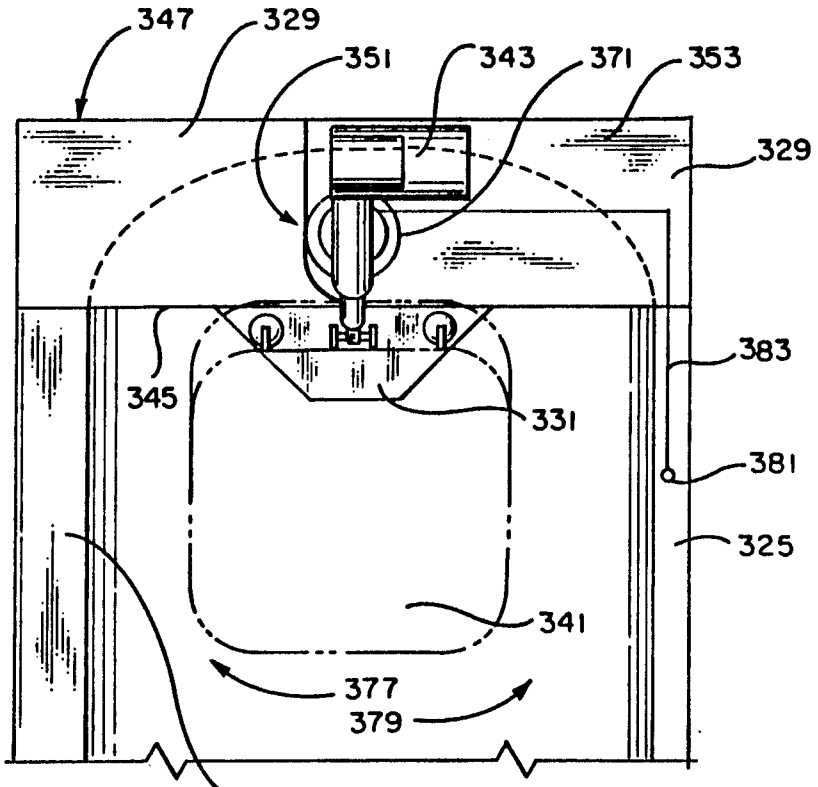
FIG. 13 is a top plan view of the device of FIG. 10, with the lift chair shown in a simplified and fragmentary view form.

As shown in FIGS. 10 and 13, support surface 331 is coupled to forward edge 345 of base 329, and depends downward from forward edge 345 at an angle, and in substantial alignment with bathtub backwall 319. As shown in FIG. 11, rearward edge 347 is coextensive with upper rim surface 327 of bathtub backwall 319.

Returning now to FIG. 10, mechanical actuator 335 is provided for raising and lowering lift chair 341, which is coupled thereto, between an elevated loading position and a lowered bathing position. In the preferred embodiment, mechanical actuator 335 includes stationary member 337, and movable member 339. Preferably, actuator 335 includes upper end 361, and lower end 363, with the actuator disposed substantially vertically upward from base 329, in substantial alignment with support surface 331, with lower end 363 disposed adjacent forward edge 345 of base 329. In this configuration, when in the bathing position, actuator 335 is predominantly disposed outside of bathtub 313, rendering the lift device 311 easy to keep in good clean working order.

In the preferred embodiment, mechanical actuator 335 is a worm gear assembly with a cylindrical stationary member 337 and a movable rod member 339 which is advanced and retracted relative to cylindrical stationary member 337 by operation of prime mover 343. Preferably, prime mover 343 comprises a DC operated reversible electrical motor which is mounted to upper end 361 of mechanical actuator 335. The actuator 335 may be similar to that as actuator 121 of FIG. 9 with the motor 141 driving a gear which directly drives the worm gear 1496.

Mechanical actuator 335 is slidably coupled to cylindrical stationary member 365 by sliding bracket 369 at upper region 361 of lift chair 341. Lift chair 363 is fixedly coupled to movable rod member 339 at the lower end 367 of mechanical actuator 335. Prime mover 343 operates to advance and retract movable rod member 339 and connected lift chair 341 between an elevated loading position with the lift chair above the bathtub sidewalls 315, 317, and a lowered bathing position with lift chair 341 within bathtub 313.

Mechanical actuator 335 is also connected to base 329 at central post 355, which juts upward from the center region of base 329, by mounting bracket 371 which allows mechanical actuator 335 and connected lift chair 341 to be rotated relative to central post 355. Actuator 335 is pivotally coupled to the bracket 371 by band 372 and pivot member 371P as shown in FIG. 10 and 11. Bracket 371 is rotatably secured to the top of post 355 and post 355 is secured to the base 329. This allows lift chair 341 to be rotated between a position with lift chair 341 in axial alignment with bathtub 313, and a position with lift chair 341 transverse to the central axis of bathtub 313. FIG. 10 is a view with lift chair 341 transverse to the central axis of bathtub 313. FIG. 11 is a view with lift chair 341 in axial alignment with the central axis of bathtub 313.

In FIG. 11, lift chair 341 is shown twice: once in an elevated position, and again in fragmentary view in a lowered position. As shown, wheel assemblies 349, 350 are provided and positioned between lift chair 341 and support surface 331. As movable rod member 339 is advanced and retracted relative to cylindrical stationary member 365, wheel assemblies 349, 350 operate to engage support surface 331 and ride upward and downward. Wheel assemblies 349, 350 operate to facilitate the upward and downward motion of lift chair 341, and to transfer some of the load of the person in lift chair 341 to support surface 331 and base 329.

As shown in FIG. 11, support surface 331 is pivotally connected to base 329 at pivot 373 to allow its bottom to engage the bottom of the tub. Angle 333 may vary slightly depending upon the depth 375 of the tub 313. Having a support surface 331 which depends from base 329 at pivot 373 allows lift device 311 to be used in a plurality of bathtubs 313 which have differing depths 375. In a shallower tub, with the bottom of member forming surface 331 engaging the bottom of the tub, the angle 333 will be greater than that shown.

Pivot 373 also allows lift device 311 to be collapsed to a more compact shape for storage. Support surface 331 may be either extended into a flat position, or pivoted backward into contact with base 329. This type of flexibility allows lift device 311 to be used in a plurality of bathtub types, and to be transported in a variety of transport vehicles.

Preferably when in use, support surface 331 is substantially parallel to backwall 319 of bathtub 313. When lift chair 341 is positioned fully upward into the loading position, wheel assemblies 349, 350 will advance above the level of base 329, and engage raised region 353, which is disposed on one side of base 329.

Figure 12:
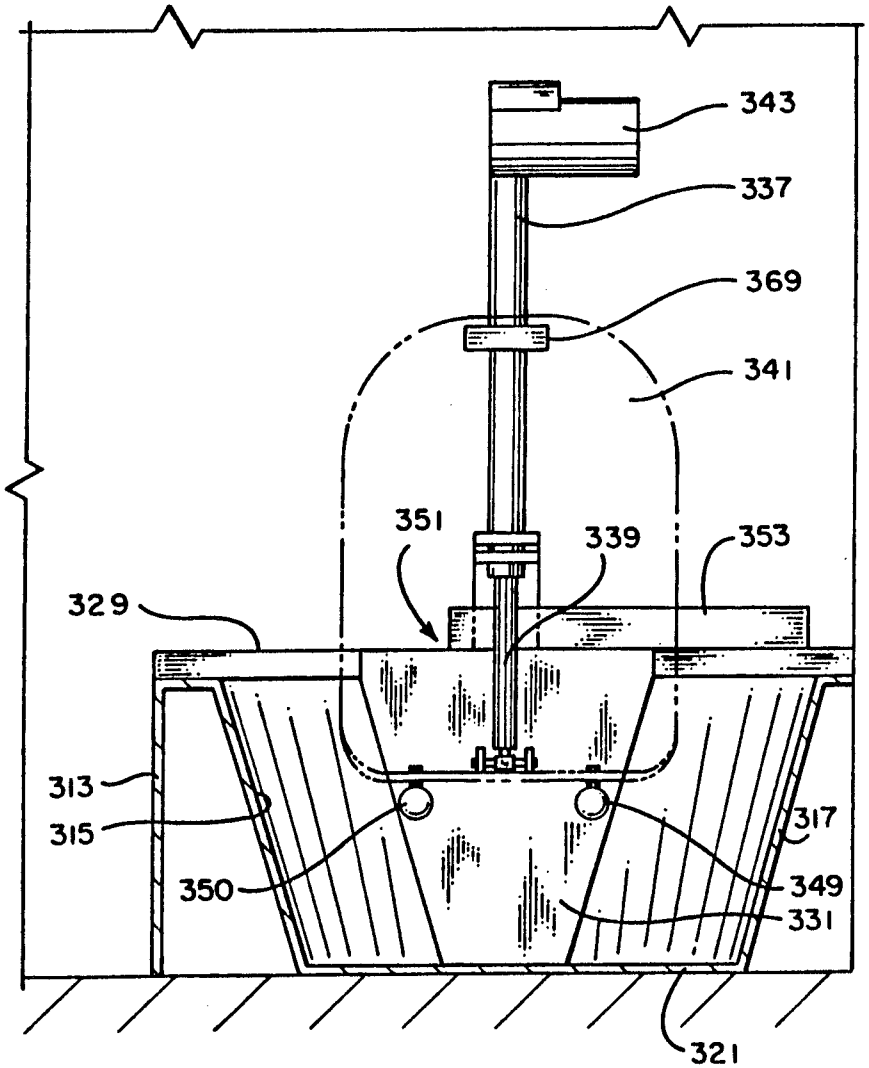
FIG. 12 is a view of the device of the FIG. 10 in a position intermediate of the loading position and the bathing position, with the lift chair shown in simplified and transparent form to reveal other features of the lift mechanism, as seen from a midpoint in the tub, with the tub shown in cross-section.

In FIG. 12, lift chair 341 is shown in simplified and transparent form, and in a position intermediate of the loading position and the bathing position. Wheel assemblies 349, 350 operate to engage support surface 331 and transfer weight from the bather to support surface 331. As shown, movable member 339 is partially extended from stationary member 337, by action of prime mover 343, which is preferably an electric motor. Sliding bracket 369 is shown in an intermediate position along the surface of stationary member 337.

When lift chair 341 is moved between an elevated loading position to a lowered bathing position, the lift chair 341 is moved simultaneously downward and forward relative to the tub. Lift chair 341 will come to rest adjacent tub bottom 321. Accordingly, only movable rod member 339, wheel assemblies 349, 350 and lift chair 341 will be submerged in bathtub 313 and thus exposed to bath water, soap, and grime. Therefore, the lift device 311 will be relatively easy to keep clean, compared to prior art lift devices.

The operation of chair guide 351 will now be described. Raised region 353 is disposed above approximately one-half of the surface area of base 329 and operates to prevent rotation of lift chair 341 in one direction, but allows rotation of lift chair 341 in the opposing direction. Chair guide 351 is best depicted in FIGS. 12 and 13. As shown in FIG. 13, wheel assembly 349 is disposed a selected distance from the axis of bathtub and will engage raised region 353 when lift chair 341 is fully elevated. However, wheel assembly 350 will not abut raised region 353 but slide backward against the guide 351. Pivot 371 allows lift chair 341 to be pivoted relative to mechanical actuator 335 in the direction of arrow 377. However, raised region 353 prevents the rotation of lift chair 341 in the direction of arrow 379, since wheel assembly 349 directly abuts a side edge of raised region 353. Of course, chair guide 351 can be adapted to provide a raised region of the opposite half of base 329, thus allowing rotation of lift chair 341 in an opposite direction.

The operation of prime mover 343 can be controlled by a three position electrical switch 381 which is electrically coupled to prime mover 343 by electrical wires 383. In the preferred embodiment, switch 381 is a three position switch, which allows one to drive prime mover 343 forward, backward, and to stop all movement, either forward or backward, and to stop all movement, either forward or backward. The switch 381 may be the same as switch 183 shown in FIG. 9 and may be coupled to a battery 181 and to the motor 43 in the same manner as shown in FIG. 9. In addition, the switch 215 of FIG. 9 may be used to allow the switch 381 to control the motor 43 only when the chair 341 is in axial alignment with the bathtub 313. It may be installed on the post 355 and closed by a knob attached to 217 when the chair 341 is pivoted from its upper transverse position to a position in axial alignment with the bathtub 313.

A variety of mechanical actuators can be employed to respond to prime mover 343. In the one embodiment, Ball Drive Actuator Model No. 85615/85616, manufactured by Motion Systems Corporation of Schrewberry, New Jersey, may be used as actuator 335. Alternately, a Series Ball Screw Model No. 2800 and 9800, manufactured by Duff-Norton, of charlotte, North Carolina may also be employed as a mechanical actuator.

Referring now to FIGS. 14–18, there will be described another embodiment of the invention wherein a side clamp 399 is used to attach the main support post 41 to the side 25 of the bathtub. Like reference numerals identify the same components as described in the embodiment of FIGS 1–9. Thus the embodiment of FIGS. 14–15 uses the same post 41 with its lower end supported on the bottom of the bathtub, the tubular member 99 and actuator 121, 163, 167 and the motor 141 and worm gear arrangement and electrical switching system of FIGS. 1, 2*a*, 2*b*, 4 and 9 for moving the chair 91 to its upward and downward positions above and in the tub. The tubular member 99 and actuator 121 are longer than that shown in the embodiment of FIGS. 1–9. Rod 169 is secured to the sleeve 99 by bolt 401 and the end of sleeve 99 is welded to a pan 403 which supports the chair 91. Bands 405A and 407A are welded to the sleeve 99 and have bands 405B and 407B connected thereto which pivotally and slidably are located around post 41. Vertical movement of tubular member 167 moves the sleeve 99 and pan 403 and hence the chair 91 upward and downward. The sleeve 99 and hence the pan 403 and chair 91 can pivot around the post 41 at least 90 to an outward position as shown in solid form in FIG. 16 for loading and unloading purposes and to an inward position above the tub as shown in dotted form in FIG. 16 where it can be lowered for bathing purposes and then raised for pivotal movement to its outward position. The upper portion of actuator member 163 is secured to the top of post 41 for pivotal movement in the same manner as shown in FIGS. 1, 2*a*, 2*b*, and 4.

The actuator 121 has a motor 141 and gears and a battery operated electrical system as shown in FIG. 9 for control purposes. The switch 183 will be located on the side rim of the bathtub and the switch 215 will be located on member 131 to be closed by knob 217 attached to bearing 133 when the chair is rotated in alignment with the center of the tub as described previously.

The side clamp 399 comprises legs 421–424 connected together at their upper ends by members 431, 433, and 435. A rod 437 connected to leg 423 has a sleeve 439 which slidably receives the post 41. Legs 421–424 have threaded holes 441 formed therethrough for receiving set screws 443 with cushioned ends 445. The legs 421, 422 and 423, 424 are spaced apart sufficient to straddle the side of the bathtub with the members 431, 433, and 435 resting on the upper rim. In this position the set screws 433 are screwed inward to tightly engage the cushioned ends 445 with the inner and outer walls of the side of the tub. This tightly secures the clamp 399 to the side of the tub. With the post 41 located in sleeve 439, the clamp 391 supports the post 41 in a vertical position with its lower end 43 engaging the bottom of the tub. Since the post 41 can slide in sleeve 439, the apparatus can be used in tubs having side walls of different heights. In addition, the clamp 399 can be installed on different sides of the tub with the sleeve 439 located in the tub.

Figure 14:
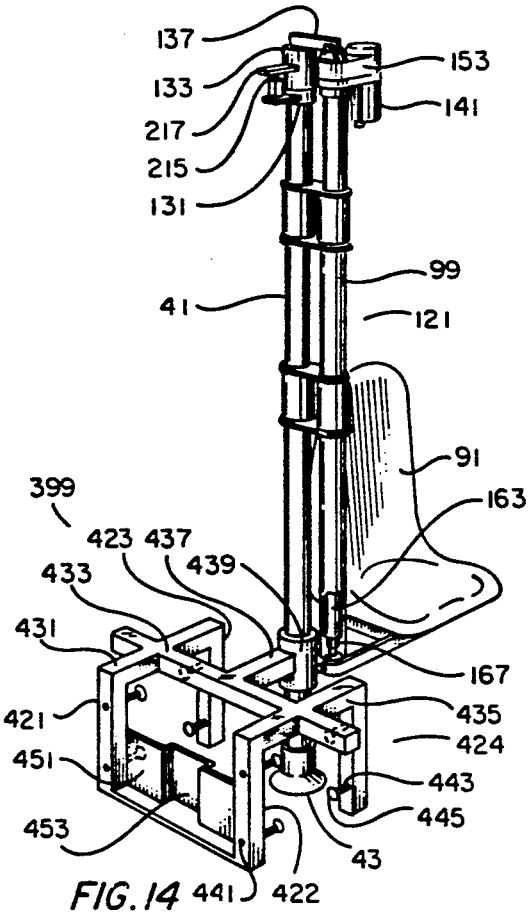
FIG. 14 illustrates another embodiment of the invention wherein a side clamp is used for attaching a main support post to the side of a bathtub.
Figure 15:
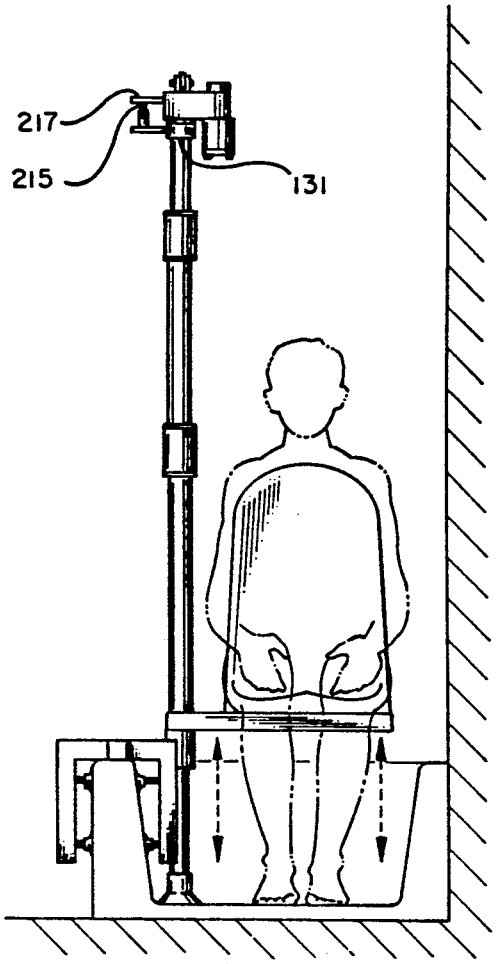
FIG. 15 illustrates the chair positioned over the bathtub.

In FIG. 14 a plate 451 is shown secured to the legs 421 and 422. The plate 451 has a cavity 453 for holding the battery 181.

Figure 17:
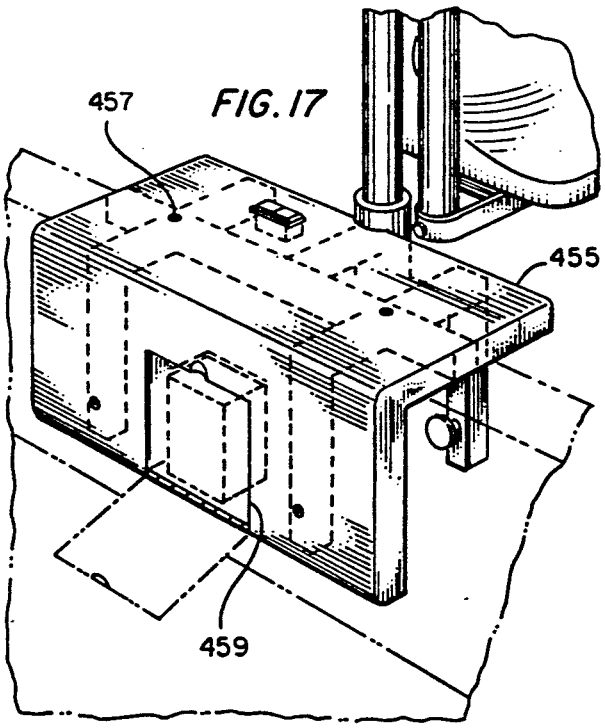
FIG. 17 illustrates a cover attached to the side clamp of FIGS. 14 and 15.
Figure 16:
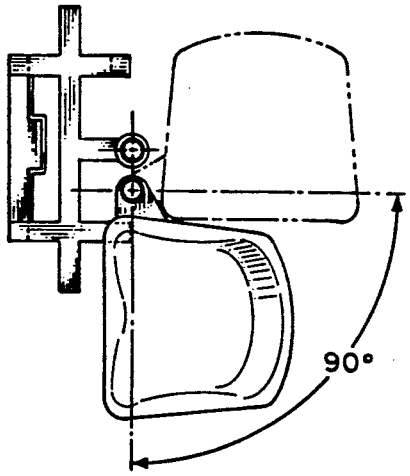
FIG. 16 illustrates lateral pivotal movement of the chair.
Figure 18:
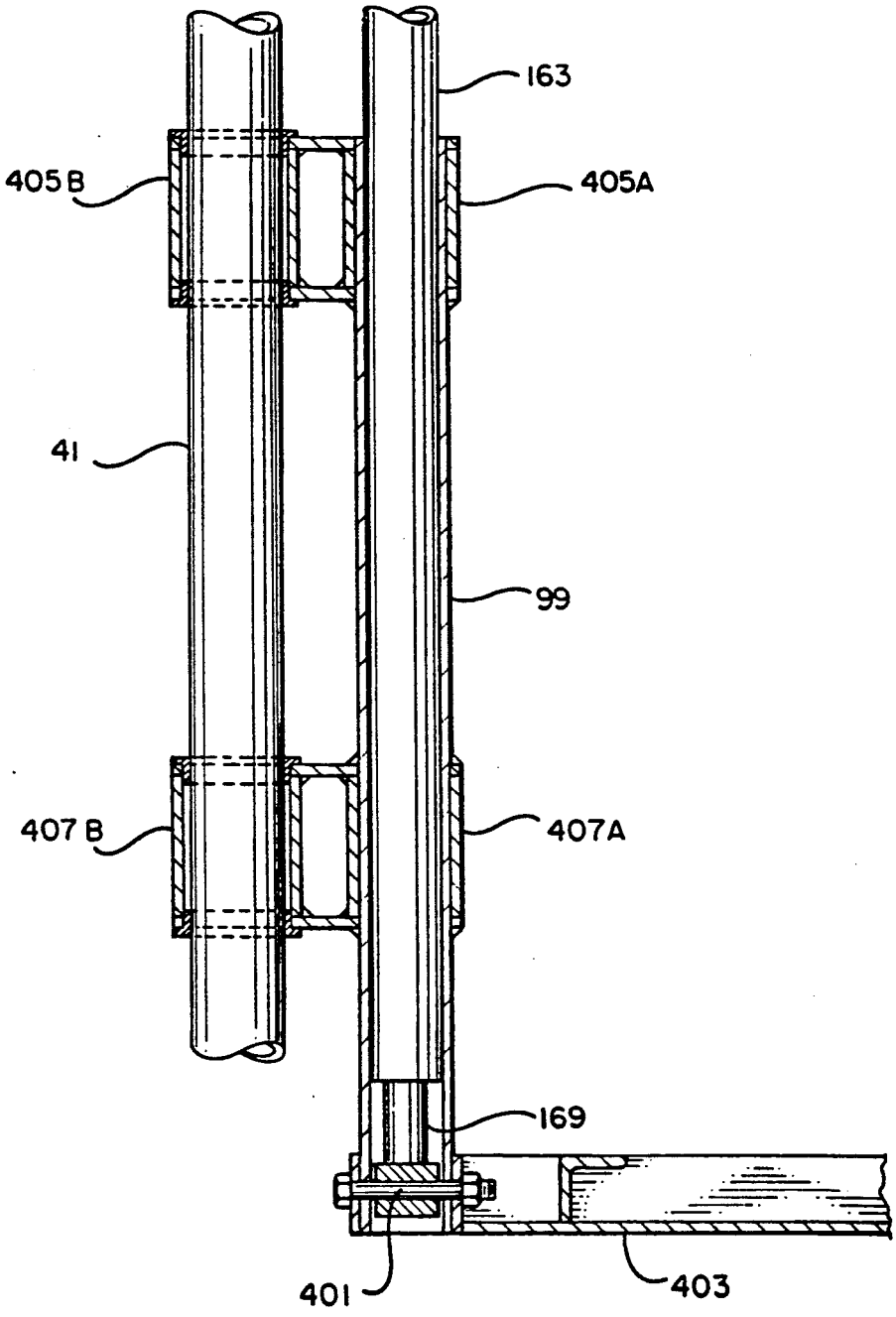
FIG. 18 is a partial cross-sectional view of the actuator as used in the embodiment of FIGS. 14–17.

In FIG. 17, a cover 455 is shown secured to the outer legs and top member 433 by bolts 457 for covering these members. A door 459 is provided for providing access to the battery 181.

I claim:

1. A lift apparatus for use in a bathtub having a bottom and side walls extending upward from the bottom to an upper rim, comprising:

support means attachable to the side walls of the bathtub, an actuator having an elongated tubular member with first and second ends and a movable member with a lower end, said movable member being movable in said tubular member to first and second positions, actuator coupling means for coupling said actuator to said support means for pivotal movement relative to said support means, means including a D.C. powered, reversible, electric motor for moving said movable member to said first and second positions, a chair for supporting a person, chair coupling means for coupling said chair to said lower end of said movable member for allowing said chair to be moved to upper and lower positions above the bottom of the bathtub when said lower end of said movable member is moved to said first and second positions respectively and said chair is in an aligned position above the bottom of the bathtub, and for allowing said chair to pivot with said actuator for movement between said aligned position and a sideways positon transverse to said aligned positions when said chair is in said upper position, and control means located within reach of a person sitting in said chair while said chair is in said upper or lower positions above the bottom of the bathtub to allow the person to control said electric motor to move said movable member to said first and second positions and hence said chair to said upper and lower positions.

2. The lift apparatus of claim 1, comprising:

means for allowing said control means to control said electric motor only when said chair is in alignment with the central portion of the bathtub.

3. The lift apparatus of claim 1, wherein:

said support means comprises a main support post and bathtub wall support means coupled to said main support post, said main support post having a lower end and an upper end with said lower end adapted to engage and be supported by the bottom of the bathtub with said upper and extending upward above the side walls of said bathtub, said bathtub wall support means being adapted to be coupled to at least one side wall of the bathtub for providing support for said main support post, said chair coupling means slidably and pivotally couples said chair to said main support post for allowing said chair to be moved to said upper and lower positions above the bottom of the bathtub and between said aligned position and said sideways position when in said upper position.

4. The lift apparatus of claim 3, wherein said bathtub wall support means comprises:

a platform having two spaced apart arms with ends connected together by a connecting portion extending transverse to said two arms defining a chair receiving space between said two arms, said two arms being adapted to rest on the upper ends of the walls of the bathtub with said lower end of the said main support post engaging the bottom of the bathtub, and at least one secondary support post coupled to said connecting portion of said platform and to said main support post.

5. The lift apparatus of claim 3, wherein said bathtub wall support means comprises:

clamp means coupled to said main support post and adapted to be clamped to at least one side wall of the bathtub.

6. The lift apparatus of claim 3, wherein:

said actuator coupling means couples and supports said actuator to said upper end of said main support post for pivotal movement about said main support post, said chair coupling means comprises tubular means slidably and pivotally located around said main support post and connecting means for connecting said chair to said lower end of said movable member and to said tubular means.

7. The lift apparatus of claim 5, said actuator coupling means couples and supports said actuator to said upper end of said main support post for pivotal movement about said main support post, said chair coupling means comprises tubular means slidably and pivotally located around said main support post and connecting means for connecting said chair to said lower end of said movable member and to said tubular means.

8. The lift apparatus of claim 1 wherein said support means comprises:

a base platform adapted to engage the upper end of the walls of the bathtub and a secondary platform pivotally coupled to the base platform and adapted to extend downward into the tub to engage the bottom thereof, said chair being slidably coupled to said actuator and pivotally coupled to said base platform at least one roller means coupled to said chair for engaging said secondary base platform for facilitating movement of said chair between said upper and lower positions.

9. The lift apparatus of claim 1 wherein said actuator comprises:

a worm gear having a helical groove which extends through a nut and means located at least in said groove such that rotation of said worm gear in one direction moves said nut upward toward said first position and rotation of said worm gear in an opposite direction moves said nut downward toward said second position, said movable member being coupled to said nut.

* * * * *